US011495207B2

(12) United States Patent
Graves

(10) Patent No.: US 11,495,207 B2
(45) Date of Patent: Nov. 8, 2022

(54) VOICE MODULATION APPARATUS AND METHODS

(71) Applicant: Greg Graves, St. Libory, IL (US)

(72) Inventor: Greg Graves, St. Libory, IL (US)

(73) Assignee: Greg Graves, St. Libory, IL (US)

( * ) Notice: Subject to any disclaimer, the term of this patent is extended or adjusted under 35 U.S.C. 154(b) by 0 days.

(21) Appl. No.: 16/909,674

(22) Filed: Jun. 23, 2020

(65) Prior Publication Data

US 2020/0394993 A1 Dec. 17, 2020

Related U.S. Application Data

(63) Continuation-in-part of application No. 16/900,574, filed on Jun. 12, 2020, now abandoned.

(60) Provisional application No. 62/861,471, filed on Jun. 14, 2019.

(51) Int. Cl.

| | |
|---|---|
| ***G10L 13/00*** | (2006.01) |
| ***G10L 13/033*** | (2013.01) |
| ***A41D 1/00*** | (2018.01) |

(52) U.S. Cl.

CPC ..... *G10L 13/033* (2013.01); *A41D 1/002* (2013.01); *G10L 13/00* (2013.01)

(58) Field of Classification Search

CPC ... G10H 2210/066; G06F 3/16; G10L 13/033; G10L 2021/0135

See application file for complete search history.

(56) References Cited

U.S. PATENT DOCUMENTS

| | | | | |
|---|---|---|---|---|
| 4,517,417 | A * | 5/1985 | Murayama | A42B 3/30 381/86 |
| 4,571,417 | A * | 2/1986 | Thoma | C09D 175/04 525/63 |
| 4,683,588 | A * | 7/1987 | Goldberg | A41G 7/02 2/410 |
| 5,349,480 | A * | 9/1994 | Takao | G10H 1/361 360/1 |
| 5,816,885 | A * | 10/1998 | Goldman | A63H 3/28 446/302 |
| 5,928,170 | A * | 7/1999 | Garrigan | A61H 19/44 601/47 |
| 5,930,373 | A * | 7/1999 | Shashoua | H03G 9/005 381/98 |
| 6,106,130 | A * | 8/2000 | Harding | G08B 5/004 362/108 |
| 6,307,140 | B1 * | 10/2001 | Iwamoto | G10H 5/005 84/669 |
| 6,377,281 | B1 * | 4/2002 | Rosenbluth | A63J 19/00 345/473 |
| 6,987,514 | B1 * | 1/2006 | Beresin | G10L 13/033 455/418 |

(Continued)

*Primary Examiner* — Jakieda R Jackson

(74) *Attorney, Agent, or Firm* — Lewis Rice LLC

(57) ABSTRACT

A modular sound modulation system that may be incorporated into a wearable harness for use beneath a costume or clothing. The system includes a sound modulation unit having an amplifier and programmable sound modulation controller. Power is provided via a wired remote power supply. Speakers are disposed at key locations to cause modulated sound to appear to come from the head of the costume. A high-fidelity microphone captured vocalizations from the wearer. The system may further include a transmitted to broadcast or store a recording of the modulated sound.

12 Claims, 8 Drawing Sheets

(56) References Cited

U.S. PATENT DOCUMENTS 7,225,414 B1 * 5/2007 Sharma ..... G06F 3/012 715/862
8,030,871 B1 * 10/2011 Young ..... A63H 19/24 446/7
8,154,227 B1 * 4/2012 Young ..... A63H 30/04 318/268
8,958,597 B2 * 2/2015 Boyd ..... H04R 9/025 381/406
9,626,950 B2 * 4/2017 McNutt ..... H04S 7/301
9,949,022 B2 * 4/2018 Kropf ..... H04R 1/44
9,953,650 B1 * 4/2018 Falevsky ..... G06F 3/011
9,995,828 B2 * 6/2018 Chang ..... G01S 19/215
10,433,086 B1 * 10/2019 Juszkiewicz ..... H04R 3/005
10,531,222 B2 * 1/2020 Tsingos ..... G10L 21/0232
2002/0060628 A1 * 5/2002 Baker ..... A63B 71/06 340/286.01
2002/0197960 A1 * 12/2002 Lee ..... A41D 1/005 455/66.1
2003/0115063 A1 * 6/2003 Okunoki ..... G10L 13/00 704/266
2003/0134591 A1 * 7/2003 Roberts, Jr. ..... G08C 17/02 455/3.06
2005/0066279 A1 * 3/2005 LeBarton ..... G11B 27/10 715/725
2008/0019540 A1 * 1/2008 van Kats ..... H04R 3/00 381/113
2008/0070214 A1 * 3/2008 Strauser ..... G09B 19/00 434/307 A
2009/0296044 A1 * 12/2009 Howell ..... G02C 5/143 351/158
2010/0292895 A1 * 11/2010 Nakamura ..... G06V 20/582 701/41
2012/0014553 A1 * 1/2012 Bonanno ..... H04R 3/04 381/364
2013/0089208 A1 * 4/2013 Fairey ..... H04R 5/04 381/17
2013/0230188 A1 * 9/2013 Cornejo Lizarralde ..... G10K 11/175 381/94.1
2013/0336493 A1 * 12/2013 Schild ..... H04R 1/083 381/365
2015/0106103 A1 * 4/2015 Fink, IV ..... G10L 21/003 704/270
2015/0276202 A1 * 10/2015 Haslem, Sr. ..... G08B 5/004 362/108
2016/0041808 A1 * 2/2016 Pelland ..... H04R 3/00 381/123
2017/0005465 A1 * 1/2017 Wyland ..... H02H 9/04
2017/0053260 A1 * 2/2017 Zhou ..... G06Q 20/00
2017/0248644 A1 * 8/2017 Ledbetter ..... A42B 1/242
2017/0340285 A1 * 11/2017 Rubin ..... A61B 5/6891
2018/0160975 A1 * 6/2018 London ..... A61B 5/1118
2018/0190260 A1 * 7/2018 Christoph ..... G10K 11/17861
2019/0132948 A1 * 5/2019 Longinotti-Buitoni ..... A61B 5/7278
2020/0075033 A1 * 3/2020 Hijazi ..... G06N 3/006
2020/0112455 A1 * 4/2020 Shoop ..... H04L 67/303
2020/0197810 A1 * 6/2020 Kung ..... A63F 13/54
2020/0236487 A1 * 7/2020 Kratz ..... H04S 7/303
2020/0379710 A1 * 12/2020 Montisano ..... G06F 3/165

* cited by examiner

VOICE MODULATION APPARATUS AND METHODS

CROSS-REFERENCE TO RELATED APPLICATIONS

This application Continuation-in-Part application of U.S. patent application Ser. No. 16/900,574, filed Jun. 12, 2020, which claims the benefit of U.S. Prov. Pat. App. Ser. No. 62/861,471, filed Jun. 14, 2019, the entire disclosures of which are incorporated herein by reference.

BACKGROUND OF THE INVENTION

Field of the Invention

This disclosure is related to the field of electronic modulation devices, and more particularly to a sound modulation device for adapting vocalizations.

Description of the Related Art

Voice changers, also sometimes known as "voice enhancers," are devices which change the tone or pitch of vocalizations, or add distortions or other effects, to alter the received sound of the vocalization. A simple example of such a device is a simple kazoo, a small mechanical device that imparts a "buzzing" timbre to a vocalization.

More sophisticated devices use modulation and are known as "voice modulators." Such devices receive the acoustic vocalization and convert them to a digital signal, vary or alter the waveform representation of the vocalization, and then play the altered waveform through a speaker. Doing this in essentially real-time results in a digital "voice modulation" technique.

However, voice modulators generally result in poor sound output of insufficient quality for commercial use. Prior art voice modulators generally use a relatively low-power amplifier of 3 W, usually less. Prior art modulators generally use a common chip using common architecture, such as Arduino. These components result in a low-volume, poor quality timbre insufficient even for use even in cosplay, much less professional production.

For example, in television and film, distortions to vocalizations are generally applied in post-production and then mixed back into the audio recorded during live filming. This is because a live modulator used during filming is too quiet, and the quality of the sound output is too poor, to be picked up. This reduces the overall audio quality of the film, however, because exactly mimicking the audio conditions of the soundstage or location in post-production is almost impossible. Thus, modified vocalizations sometimes do not have the some timbre as audio recorded live, which is jarring to the audience and makes it more difficult to suspend disbelief.

Similarly, voice modulators also generally lack sufficient power and clarity for use even in more sophisticated hobby settings. Cosplayers and Halloween enthusiasts prefer high-quality, high-realism costumes. Many such costumes represent fantasy or science fiction creatures. If the person speaks in his or her normal speaking voice, the juxtaposition of a normal human voice with, say, a demon or undead monster, shatters the illusion of the costume. While a voice modulator could be used to alter the timbre of the vocalizations, prior art voice modulators are too poor quality, and too quiet, to make this convincing.

Correcting this is not a simple matter of using higher quality components, because improvements in quality, clarity, and volume correspond to increases in power requirements, which in turn requires larger, heavier, hotter batteries. Moreover, with increases power comes increased feedback. For the illusion of real-time modulation to work, the speakers must be placed somewhat near the mouth of the costume, but this is also normally where the performer's mouth is, and thus where the microphone should be. This in turn gives rise to feedback. Prior art modulation devices avoid this by minimizing power so that the volume output of the speaker is too weak to feedback through the microphone.

Additionally, a modulator used with a costume, or even in a film or television setting, is preferably wireless and portable. However, prior art voice changers are battery-operated and drain substantial power, requiring frequent battery changes. This in turn requires the enclosure to be removed from the costume, opened, the batteries changed, and the modulator replaced. This is time-consuming and, again, ruins the illusion of realism.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Because of these and other problems in the art, described herein, among other things, are voice changer devices and methods that produce consistent, clear, loud, high-quality modulated output.

Described herein, among other things, is a wearable, modular sound modulation system comprising a vest adapted to be worn on a human torso and having a plurality of pockets disposed thereon; a sound modulator removably positioned within a first pocket of the vest; at least one speaker removably positioned within a second pocket of the vest, the speaker in electrical communication with the sound modulator a microphone in electric communication with the sound modulator; a power supply removably disposed within a third pocket of the vest, the power supply in electric communication with the sound modulator and supplying electrical power thereto.

In an embodiment of the system, the sound modulator comprises: a housing defining a housing interior, an amplifier disposed within the housing interior and in electric communication with the at least one speaker via a port through the housing; and a sound modulation controller.

In a further embodiment of the system, the amplifier is at least a 15 watt amplifier.

In a further embodiment of the system, the power supply supplies power at a first voltage, and the sound modulator further comprises a booster board adapted to increase the first voltage to a second voltage.

In a further embodiment of the system, the first voltage is about 3.7 volts and the second voltage is about 5 volts.

In a further embodiment of the system, the sound modulation controller is a programmable controller.

In a further embodiment of the system, the sound modulator comprises one or more potentiometers operable across a range of settings via a corresponding user-manipulated control system disposed outside the housing, the one or more potentiometers moderating the degree of sound modulation by the controller in accordance with a user-selected setting of the control system.

In a further embodiment of the system, the sound modulator further comprises a sound card operatively coupled to the controller, the sound card preprogrammed with one or more preset sound effects.

In a further embodiment of the system, the system further comprises one or more fingertip controllers in electrical communication with the sound modulator such that when the fingertip controllers are worn by a human user and activated, one of the preprogrammed sound effects is played through the at least one speaker.

In a further embodiment of the system, the first pocket is disposed at a belt buckle position of the vest.

In a further embodiment of the system, the at least one speaker comprises a plurality of speakers, at least one speaker in the plurality being a subwoofer.

In a further embodiment of the system, the at least one speaker produces modulated sound output of about 100 dB.

In a further embodiment of the system, the second pocket is disposed at a lapel position of the vest.

In a further embodiment of the system, the third pocket is disposed at a back position of the vest.

In a further embodiment of the system, the vest comprises a cooling system.

In a further embodiment of the system, the microphone and the at least one speaker are disposed in positions effective to eliminate feedback.

In a further embodiment of the system, the vest further comprises one or more cable management straps.

In a further embodiment of the system, the system further comprises a wireless transceiver in communication with a public address system, the wireless transceiver transmitting sound modulated by the sound modulator.

In a further embodiment of the system, the system further comprises a wireless transmitter in communication with a sound recording system, the wireless transceiver transmitting sound modulated by the sound modulator.

In a further embodiment of the system, the power supply is a rechargeable 12 volt battery.

DESCRIPTION OF THE PREFERRED EMBODIMENT(S)

The following detailed description and disclosure illustrates byway of example and not by way of limitation. This description will clearly enable one skilled in the art to make and use the disclosed systems and methods, and describes several embodiments, adaptations, variations, alternatives and uses of the disclosed systems and methods. As various changes could be made in the above constructions without departing from the scope of the disclosures, it is intended that all matter contained in the description or shown in the accompanying drawings shall be interpreted as illustrative and not in a limiting sense.

Figure 1:
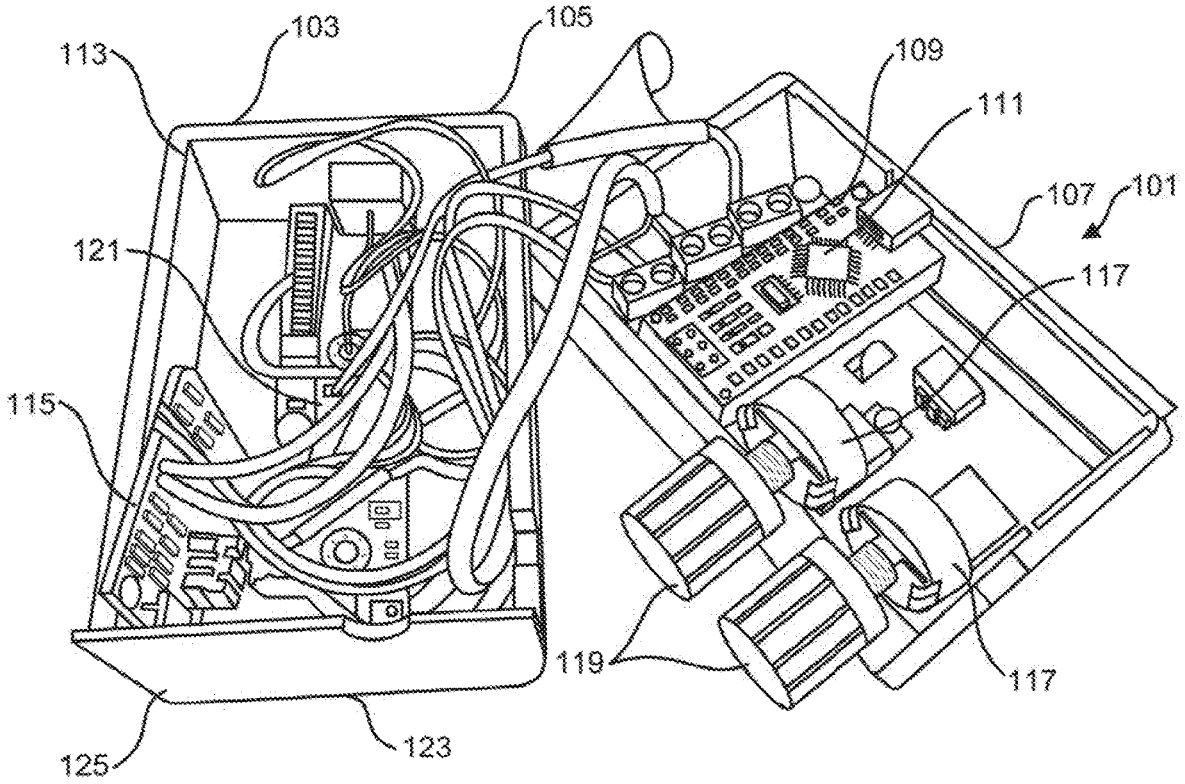
FIG. 1 depicts an embodiment of a modulator according to the present disclosure.
Figure 2:
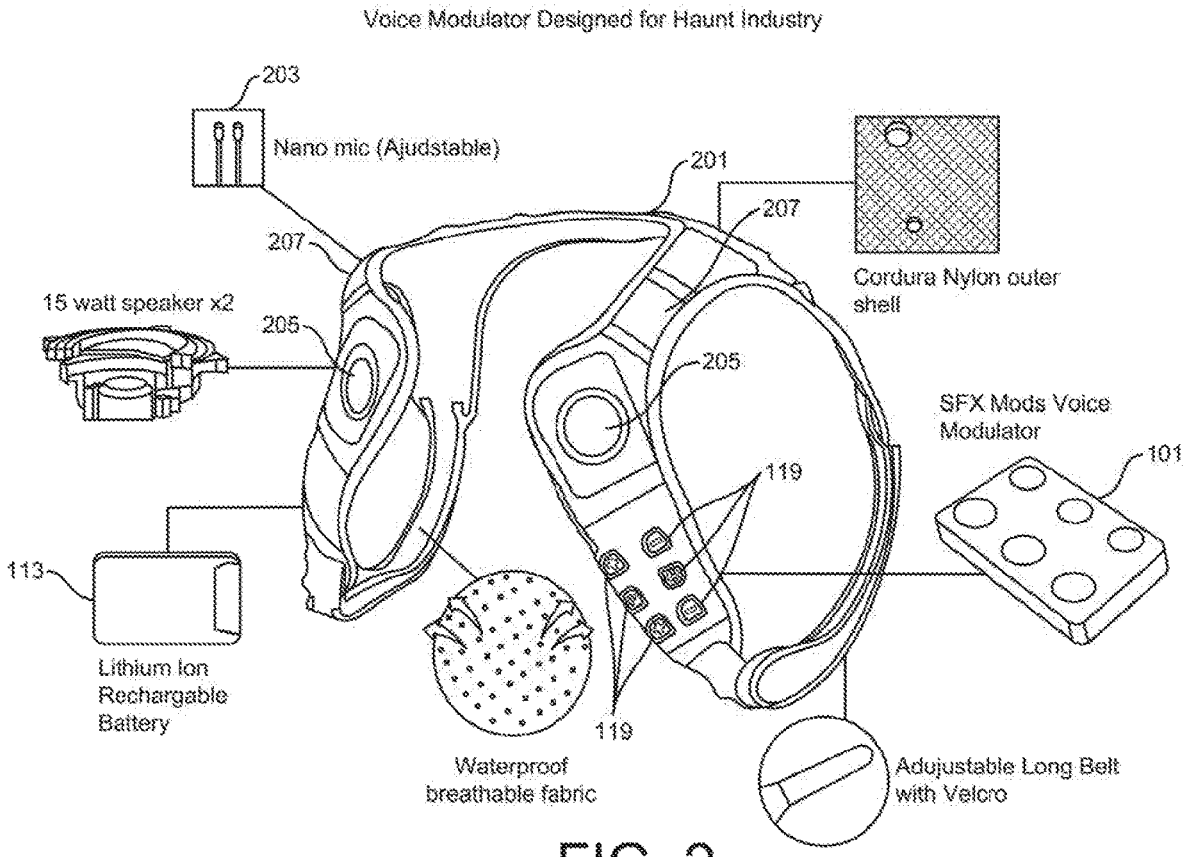
FIG. 2 depicts an embodiment of a modulator incorporated into a wearable harness according to the present disclosure.
Figure 3:
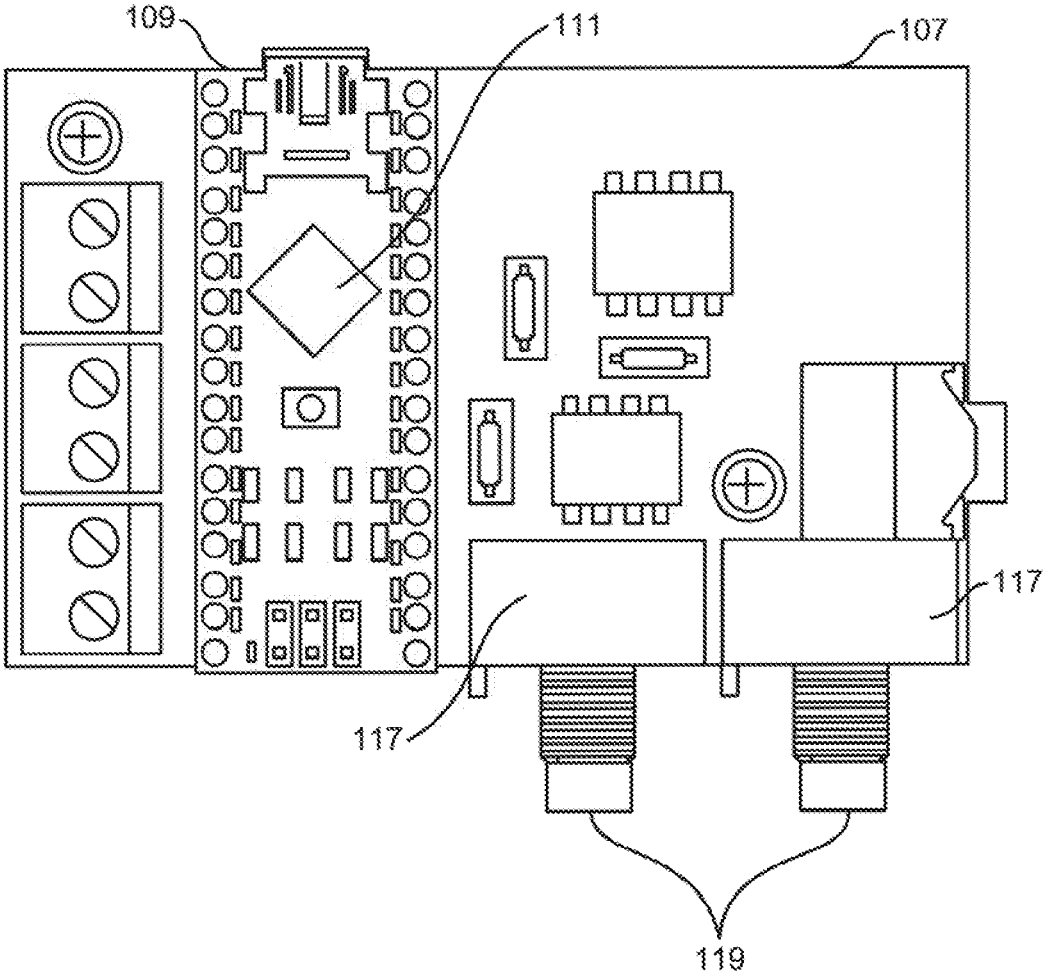
FIG. 3 depicts a diagram of an embodiment of a control board and related circuitry for a modulator according to the present disclosure.
Figure 4:
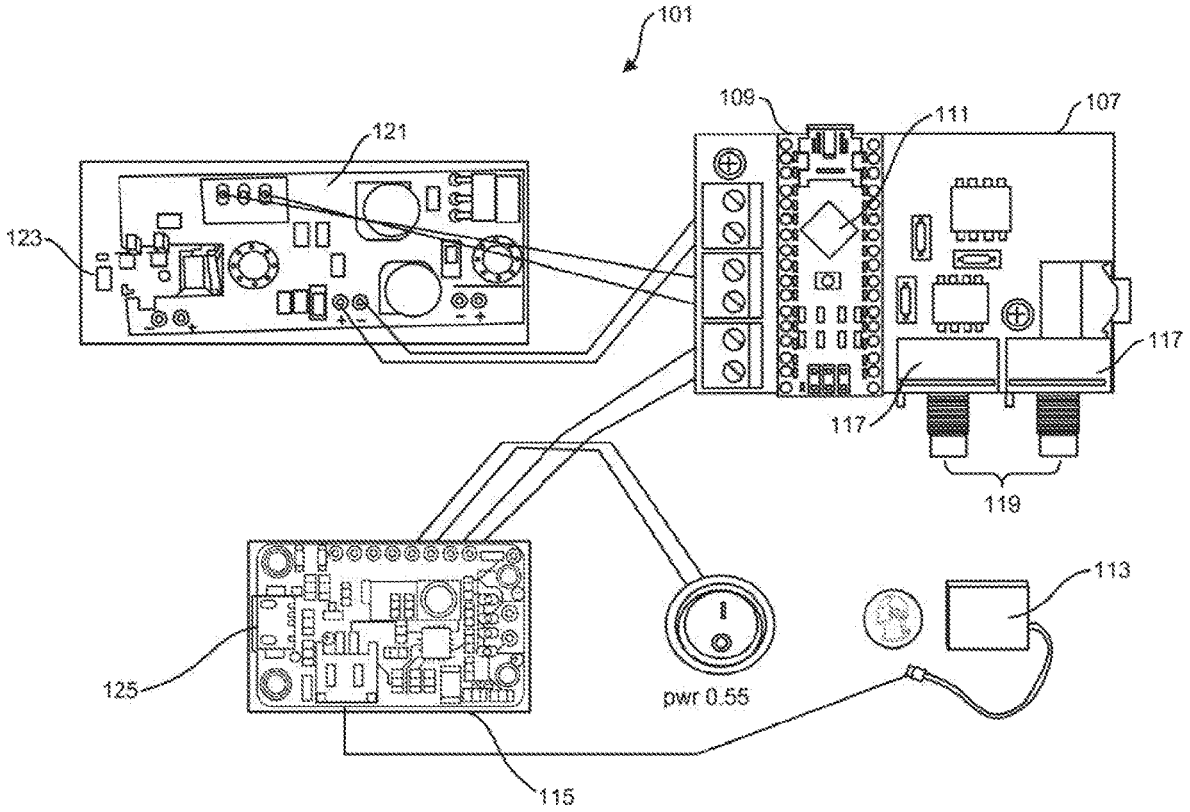
FIG. 4 depicts the embodiment of FIG. 3 wired to power supply and other components of a modulator according to the present disclosure.
Figure 6:
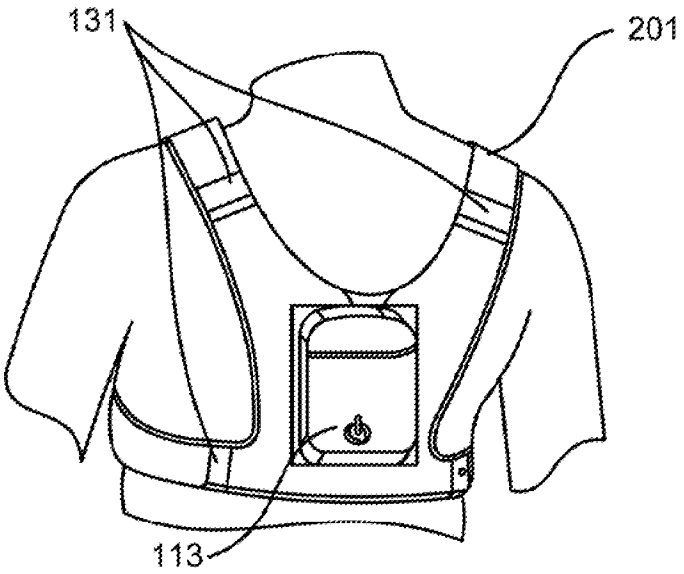
FIG. 6 depicts aback view of an alternative embodiment of a wearable harness according to the present disclosure.
Figure 5:
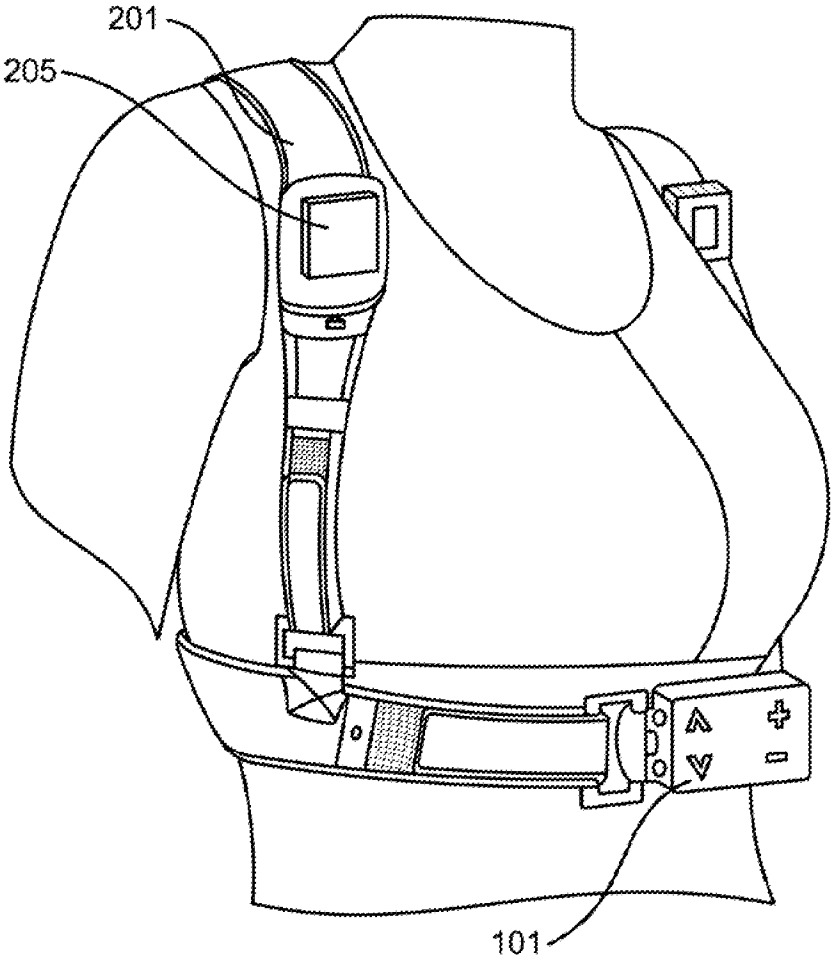
FIG. 5 depicts a front view of an alternative embodiment of a wearable harness according to the present disclosure.
Figure 7:
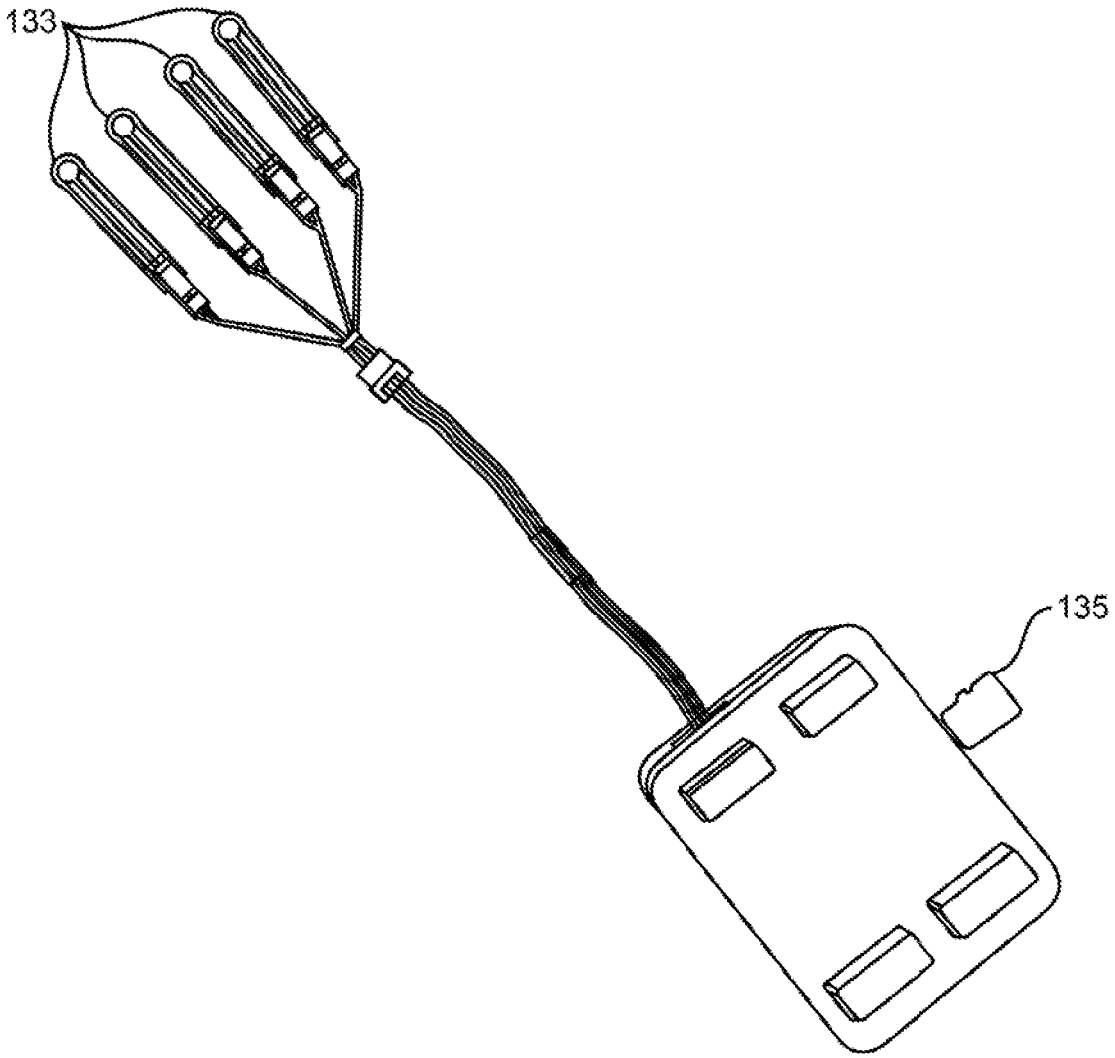
FIG. 7 depicts an embodiment of fingertip controls for a sound modulator according to the present disclosure.
Figure 8:
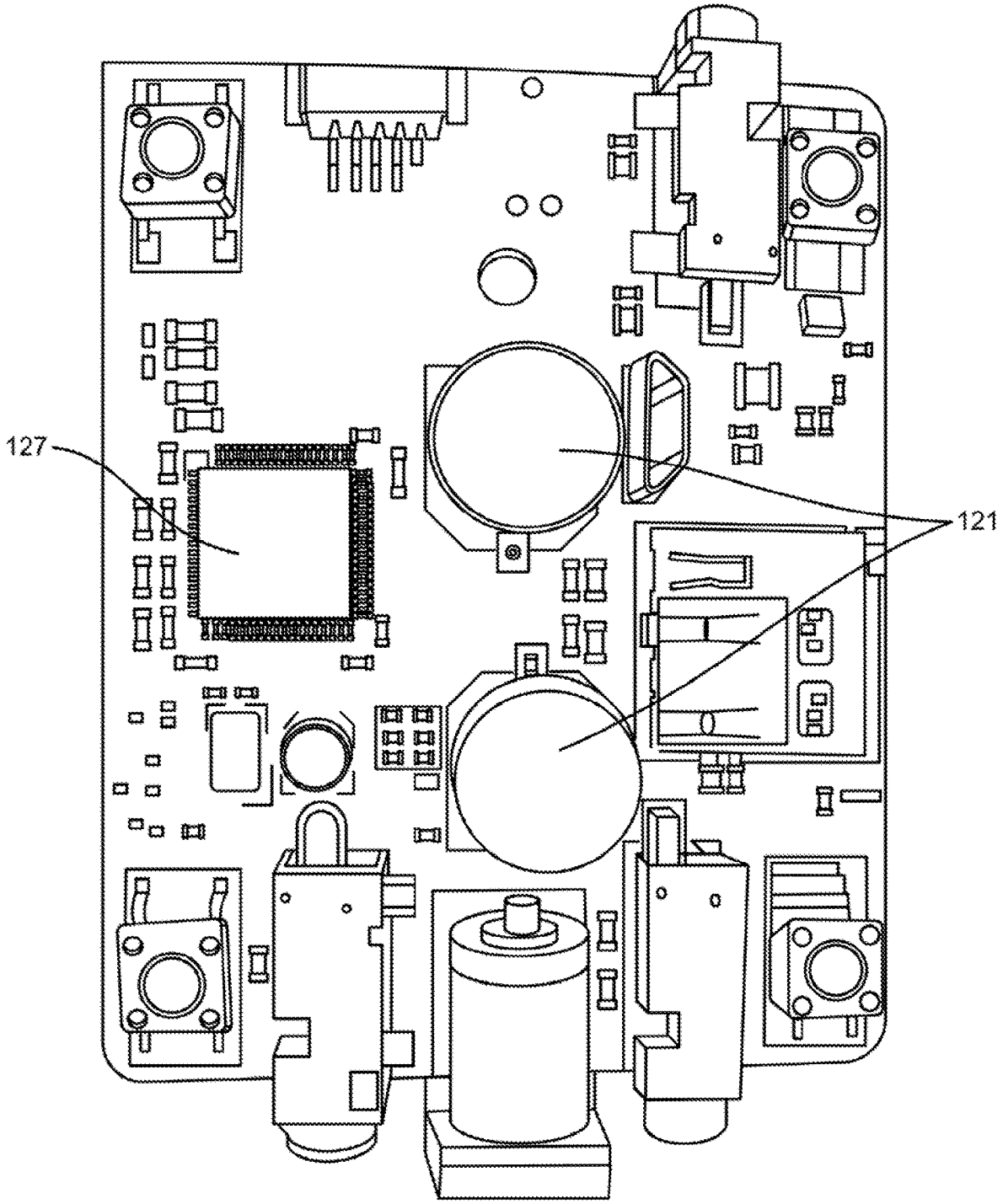
FIGS. 8 and 9 depict the top and bottom of an alternative embodiment of a circuit board adapted for the sound modulation according to the present disclosure.
Figure 9:
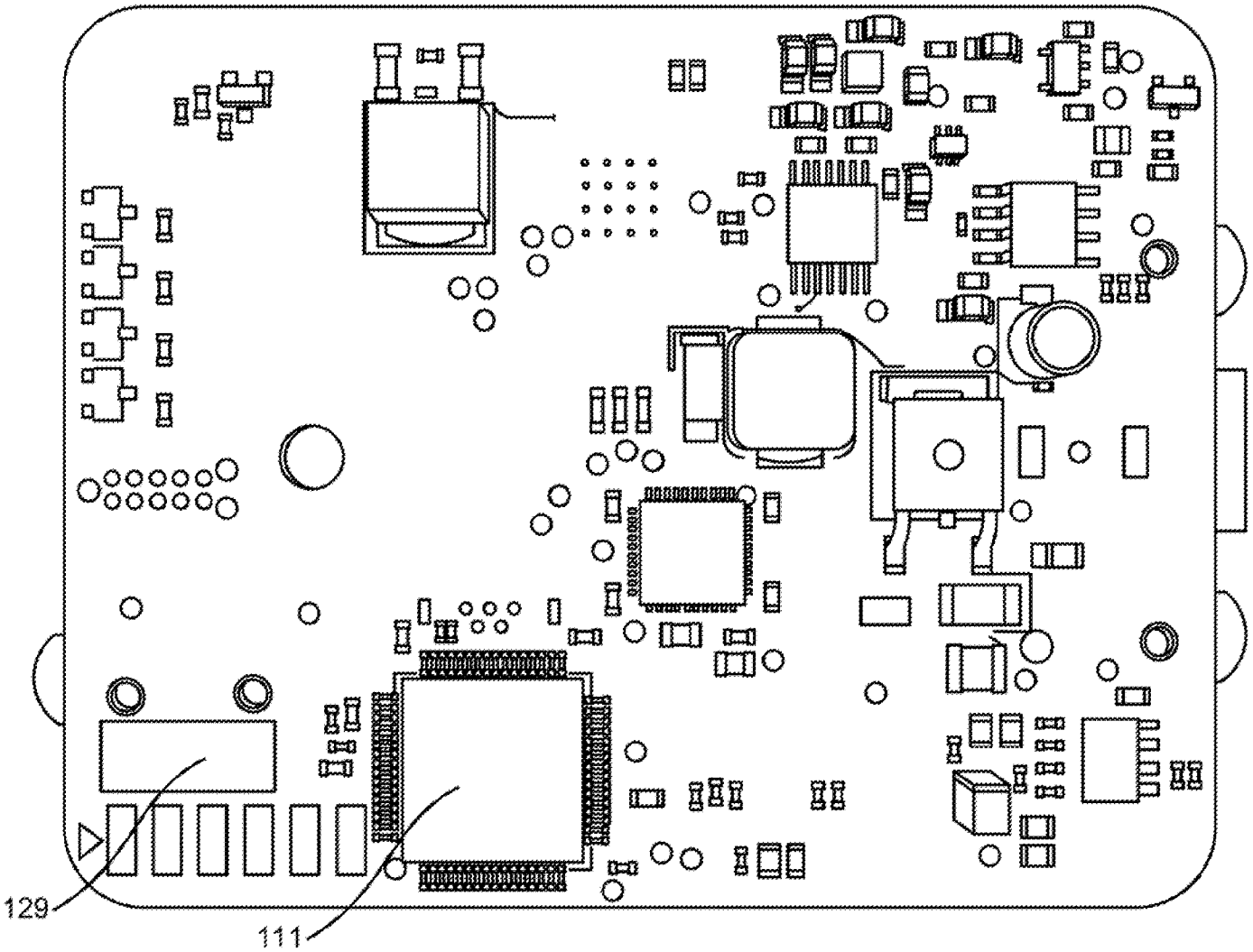

Because of these and other problems in the art, described herein, among other things, are voice changer devices and methods that produce consistent, clear, loud, high-quality modulated output. Additionally, the problems of short battery life and suspension of disbelief are addressed through a modular vest or other item of apparel that can be worn under, or integrated into, a costume, which provides modular attaching points for the components of a modulator without the need for a uniform enclosure, allowing for easy battery change and even self-contained failover/backup batteries that don't require the modulator to be removed or disassembled. These and other features are described in further detail herein. FIGS. 1, 3-4 depict an embodiment of a voice modulator (101) as described herein. FIG. 2 depicts an embodiment of a voice modulator incorporated into a wearable apparatus. FIGS. 5-6 depict an alternative wearable apparatus embodiment, and FIG. 7 depicts an embodiment of fingertip controls as described elsewhere herein. FIGS. 8-9 depict an alternative embodiment of a voice modulation circuit board.

In the depicted embodiments, some or all of components are enclosed within a rigid shell or housing (103) to prevent damage or breakage. The depicted housing (103) is in the nature of a clamshell design, having a first or bottom half (105) and a corresponding second or top half (107) configured to mate to the bottom half (105) and thereby form the enclosure (103). The enclosure should be made of a lightweight and rugged material, preferably with sufficient thermal conductivity to limit heat accumulation within the enclosure (103).

In the depicted embodiment, a high quality, integrated 15 W amplifier (121) is provided, which achieves better sound quality, clarity, and loudness. The depicted amplifier (121) is in electric communication with a port (123) for connecting one or more external speakers (205) to receive the amplified carrier signal. The depicted port (123) is a standard 3.5 mm port, but other types of connections may be substituted. The depicted embodiment (101) further includes a port for connecting an external microphone to the device through the enclosure (103). The microphone may be connected through a standard 3.5 mm port or any other type of port, depending on which standard is desired in a given embodiment. In an alternative embodiment, an amplifier with high wattage is used. By way of example and not limitation, in an embodiment, a 30 W amplifier may be used.

In the depicted embodiments, a power supply (113) is included to power the amplifier and external microphone. The depicted power supply in FIG. 1 is a 3.7V rechargeable chemical cell or battery. In the depicted embodiment, the power output is increased to about 5V via a separate booster board (115), which also provides the circuitry to connect an external charger via a charging port (125). Although an internal 3.7V battery is depicted, it is anticipated that a preferred commercial embodiment would utilize a rechargeable, swappable 12V external battery, an embodiment of which is described herein with respect to FIG. 2. In an embodiment, the external battery is hot-swappable. The battery may be charged via a micro USB port. In an embodiment, a control board may be included for power management, which can provide power to both 5V and 12V embodiments.fDSP In the depicted embodiment of FIGS. 1, 3, and 4, the modulator (101) includes a control board (109) and controller (111) thereon. The depicted controller (111) is programmable to implement modulation in accordance with the particular type or degree of modulation desired. The depicted controller (111) of FIG. 1 is a microprocessor (111), which performs or causes to be performed the actual modulation of the carrier signal.

In an alternative embodiment, the microprocessor does not necessarily directly perform the modulation, but rather operates other electronics which perform the modulation. By way of example and not limitation, in the depicted embodiment of FIGS. 8-9, the control board comprises a microprocessor which operates the various other components, including a digital signal processor (a "DSP"). The depicted DSP (127) is adapted to receive audio signals from a microphone or other audio capture device and modify the signals to produce the desired modulated audio output signal, which is then played through one or more connected speakers. The DSP (127) may be programmable and/or may be a solid-state device. In an embodiment, the DSP (127) comprises an equalizer, which may be configured to produce the desired output.

In the depicted embodiments, the modulator (101) comprises a system for controlling the amount or degree of modulation. This system may be a set of one or more potentiometers (117), which may be referred to herein in the singular for sake of simplicity. The depicted potentiometer (117) is generally operable across its range of possible settings via a corresponding user-manipulated control (119) disposed outside of the enclosure, and operatively coupled to the potentiometer through an aperture in the enclosure. In the depicted embodiment, this aperture is formed by two corresponding recesses in the top (107) and bottom (105) sections of the enclosure (103).

In one embodiment, the modulation amount is determined when the modulator (101) is powered on, and locked at that setting until the modulator (101) is reset (e.g., via a power cycle). Alternatively, a "lock" toggle (not shown) may be included, which prevents the modulation setting from changing even if the control (119) is manipulated. This may be desirable where the device (101) may be jostled and the user does not wish to have the setting inadvertently changed, because it may be difficult to reset to exactly where it was, or to reach the control (119) at all while costumed. Alternatively, a "reset" button may be included which causes the modulation settings to be reset based on its current position. This may be done via a power cycle.

The modulation control (119) may be analog, as in the depicted embodiment, but in an alternative embodiment, a digital control may be provided in addition, or alternatively, to the analog control. The digital control may have a default setting on power-on, or may remember its prior settings and default to them.

In an embodiment, the modulator (101) includes a sound card operatively coupled to the controller. The sound card may be preprogrammed or preset sound effects that cannot be generated by a human, even with modulation. These sound effects can be played through the speaker when activate. The sound effects may be activated by external controls disposed on the housing (103), or by remote activators. The activators could be operated by the person using the modulator (e.g., a performer), or remotely by another person. In an alternative embodiment, the sound card may be replaced by, or supplemented by, a removable media (135), such as, but not necessarily limited to, a flash memory card such as an Secure Digital card, or SD card. Preset recordings may be stored on the card, and the card is electrically connected to the sound modulation system via a port in the housing.

For activation by the performer, a simple touch or tap pad (133133) may be wired to the controller with contacts placed in the fingertips of the costume, so that the performer may use his or her fingers to activate them. An embodiment of such controls is depicted in FIG. 7. Alternatively, an accelerometer may be used to detect specific motion or gestures that activate specific sound effects. Alternatively, the system may comprise a wireless transmitter (129), which can pair with a remote device, such as a smart phone or other mobile device, for operation via an application on the smart phone. This would permit, for example, in a stage or studio performance, an off-camera or off-stage operator to manage the sound effects via the application, freeing up the actor to focus on the performance without attempting to activate the presets during the performance, which could be distracting to the audience and inhibit the quality of the performance.

For an external operator, a wired connection with an external control may be used, or the system may include a wireless transceiver (129) and corresponding circuitry for receiving external commands wirelessly to control the modulator (101). Such commands may be provided by a special-purpose remote control, or by a smart device, such as a software program or app running on a computer, tablet, or smart phone. In an embodiment, the sound card may be in the nature of a hot-swappable storage medium, such as an SD card. This allow a single modulator (101) to be programmed with a range of pre-loaded sound effects or modulation code without substantially altering the hardware.

Although FIG. 1 depicts the amplifier and microphone as separate circuitry from the control board, it is contemplated that most or all of the major circuitry of FIG. 1 can be condensed into a more compact, smaller form-factor, such as a singular board. This will reduce the weight, complexity, wiring, and failure points of the device. Likewise, the large controls (119) may be replaced by smaller push-buttons to digitally operate the potentiometer (117), as shown in the alternative embodiment of FIG. 2

In the alternative embodiment of FIG. 2, a modulator (101) with digital controls is shown, along with other components for a modular distribution of functionality on a wearable apparatus (201). In the depicted embodiment, the modulator (101) is incorporated into a wearable vest (201). The depicted vest (201) is in the nature of a shoulder harness (201). It is preferred that that wearable apparatus (201) be made from a rugged but comfortable and breathable material, and be waterproof or water resistant to reduce wear caused by the natural perspiration of the performer wearing the vest (201).

In the depicted embodiment of FIG. 2, the modulator (101) is installed within a pocket on a front lapel of the vest. The pocket has a plurality of controls (119) disposed on the outside thereof, which correspond to the location of the controls on the exterior of the modulator (101) housing. Thus, when the user presses one of the controls (119) on the lapel, the pressure passes through to the modulator (101) to operate it. Symbols on the lapel help the user understand the function of each control.

In the depicted embodiment of FIG. 2, one or more powered speakers (205) are also disposed within the vest. The depicted speakers are disposed on the front label close to the top of the vest (201). This provides the illusion that the sound is originating from the mouth of the costume (which is normally at or near the mouth of the wearer. The speakers (205) are wired to the modulator (101) through a short run of shielded or insulated wire through the vest (201) body. The depicted speakers are 2", 15-20 W speakers. In an embodiment, the speakers may have a "pill"-shaped contour which provides superior sound amplification and quality. The speakers may be "plug-and-play" style speakers. That is, if a speaker is damaged, it may simply be popped out of the socket in the vest (201) and a new one popped in.

Similarly, in the depicted embodiment of FIG. 2, a microphone (203) is also connected to the modulator (101) through a short run of shielded or insulated wire through the vest (201). The depicted microphone (203) is in the nature of a nana mic, and is preferably waterproof or water resistant, and washable such that make-up, costume glue, and other such materials may be applied to it. The microphone may be disposed at the lapel and may include a longer run of wire so that once the outer costume is donned, the mic (203) can be run to near the performer's mouth. In an alternative embodiment, a wireless mic may be used.

The depicted vest (201) further includes one or more subwoofers (207) disposed near the shoulders. The depicted subwoofers are 2-inch, full-range, 180-degree dispersion passive subwoofers. In an alternative embodiment, powered subwoofers may be included.

The depicted vest (201) further includes a rechargeable external battery (113) disposed in a batter pocket at the bottom of the opposite label from the modulator (101). Again, wire runs through the vest connect the battery (113) to the powered components (speakers (205), microphone (203), modulator (101)). The battery is also removable, swappable, and rechargeable. The pocket for the battery may have additional openings or ventilation to encourage thermal transfer and avoid overheating.

It is contemplated that the depicted vest (201) would be worn beneath a costume. As shown in the figure, the vest (201) has adjustable straps to accommodate performers of different ages, heights, and weights.

In the preferred embodiment, heat accumulation is expected to be limited such that a cooling system may be necessary, but if cooling is desired, a cooling system may be added. Such cooling systems may comprise one or more heat sinks, fans or blowers, liquid cooling systems, phase transition cooling, specialized fabrics, and so forth.

An aspect of the device is that avoidance of feedback. Thus, the speakers (205) and microphone (203) are disposed on the vest (201) in a location effective to eliminate or reduce feedback. Additionally, and/or alternatively, feedback may be reduced by using a directional or short-range microphone, using shielded cables and wires, and metal speakers.

In an embodiment, a high-fidelity microphone (203) may be used. Preferably, the microphone is highly miniaturized for use in the costume. In an embodiment, the microphone has a small profile of less than 3 mm and preferably less than 2.6 mm. In an embodiment, the microphone has a profile of 2.54 mm. The microphone may comprise electromagnetic interference protection, such as shielding, and may be adapted to minimize current drain in order to extend battery life. The high-fidelity microphone may be adapted to captures incident and/or ambient sound while also attenuating competing sounds from off-axis sources using noise reduction. The microphone may be connected to the modular using shielded cabling to further maintain fidelity.

FIG. 5 and FIG. 6 depict front and back perspective views of an alternative embodiment of a wearable harness. In the depicted embodiment of FIG. 5 and FIG. 6, speakers (205) are removably disposed in pockets on the lapels of the vest (201) and wired to the modulator (101), which is disposed in the belt buck position of the depicted vest (201). The vest (201) has adjustable straps in various locations to allow a single vest product to be resized to fit multiple wearers comfortably. The speakers (205) may be disposed in label pockets that are closeable, such as via a hook-and-loop system, snap, button, or other fastening means. In the depicted embodiment, the power supply/battery (113) is disposed in a pocket on the back of the vest (201) and connected to the modular by power wires. The depicted vest (201) also comprises cable management straps (131) to guide the wiring and inhibit stray wires from becoming entangled in a costume or with the wearer. In an alternative embodiment, the specific locations of the pockets containing the modulator, battery, and speakers may differ.

In an embodiment, the combination of components is effective to produce clear, modulated sound output of about 100 dB. The sound quality is suitable for use in a stage production, television or film studio, street performance, or convention or costumed event. In an embodiment, the power supply may operate at about 12V to produce sufficient energy to produce sound output up to 100 dB.

In an embodiment, the sound output may be connected to a second system for recording or rebroadcast. For example, the modular pack may include, or be connected to, a wireless transmitter (129) which can transfer the modulated sound signals to a public address system, such as in a theater environment, allowing the wear to have his or her modulated voice directly transferred to the audience without going through intervening microphone systems. Alternative, or additionally, the system may be connected to a sound recording or sound processing system. For example, in a film or television studio environment, the output from the system may be captured and recorded via sound equipment for later mixing into a final cut. The wireless transmission system (129) may include any suitable wireless transceiver (129), such as a short-range radio transceiver (129).

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A wearable, modular sound modulation system comprising:

a vest adapted to be worn on a human torso and having a plurality of pockets disposed thereon, a first pocket of said plurality of pockets disposed on a first lapel of said vest, and a second pocket of said plurality of pockets disposed on a second lapel of said vest;

a sound modulator removably positioned within said first pocket of said vest, said sound modulator comprising:

a housing defining a housing interior;

an amplifier disposed within said housing interior and in electric communication with said at least one speaker via a port through said housing;

a sound modulation controller; and a removable, non-transitory computer-readable storage medium having a plurality of pre-recorded sound effects stored thereon;

at least one speaker removably positioned within said second pocket of said vest, said speaker in electrical communication with said sound modulator;

a microphone in electric communication with said sound modulator;

a power supply removably disposed within a third pocket of said vest disposed on a backside of said vest, said power supply in electric communication with said sound modulator and supplying electrical power thereto;

a plurality of tap pads operatively coupled to said sound modulator controller, wherein said tap pads, when activated, cause a sound effect in said plurality of pre-recorded sound effects to be played through said at least one speaker; and a smart phone running a software program wirelessly controlling said modulator.

2. The system of claim 1, wherein said amplifier is at least a 15 watt amplifier.

3. The system of claim 1, wherein said power supply supplies power at a first voltage, and said sound modulator further comprises a booster board adapted to increase said first voltage to a second voltage.

4. The system of claim 3, wherein said first voltage is about 3.7 volts and said second voltage is about 5 volts.

5. The system of claim 1, wherein said sound modulation controller is a programmable controller.

6. The system of claim 1, wherein said sound modulator comprises one or more potentiometers operable across a range of settings via a corresponding user-manipulated control system disposed outside said housing, said one or more potentiometers moderating the degree of sound modulation by said controller in accordance with a user-selected setting of said control system.

7. The system of claim 1, wherein said vest comprises a cooling system.

8. The system of claim 1, wherein said microphone and said at least one speaker are disposed in positions effective to eliminate feedback.

9. The system of claim 1, wherein said vest further comprises one or more cable management straps.

10. The system of claim 1, further comprising a wireless transceiver in communication with a public address system; said wireless transceiver transmitting sound modulated by said sound modulator.

11. The system of claim 1, further comprising a wireless transmitter in communication with a sound recording system, said wireless transceiver transmitting sound modulated by said sound modulator.

12. The system of claim 1, wherein said power supply is a rechargeable 12 volt battery.

* * * * *